US011041455B2

(12) United States Patent
Kumar

(10) Patent No.: US 11,041,455 B2
(45) Date of Patent: Jun. 22, 2021

(54) ENGINE CYLINDER LINER WITH LINER CATCHER

(71) Applicant: Transportation IP Holdings, LLC, Norwalk, CT (US)

(72) Inventor: Kotha Ramesh Kumar, Bangalore (IN)

(73) Assignee: TRANSPORTATION IP HOLDINGS, LLC, Norwalk, CT (US)

( * ) Notice: Subject to any disclaimer, the term of this patent is extended or adjusted under 35 U.S.C. 154(b) by 0 days.

(21) Appl. No.: 16/688,863

(22) Filed: Nov. 19, 2019

(65) Prior Publication Data

US 2021/0148302 A1 May 20, 2021

(51) Int. Cl.

| | |
|---|---|
| ***F02F 1/16*** | (2006.01) |
| ***F02F 1/00*** | (2006.01) |
| ***F02F 11/00*** | (2006.01) |
| ***F02F 1/14*** | (2006.01) |

(52) U.S. Cl.

CPC ..... *F02F 1/004* (2013.01); *F02F 1/14* (2013.01); *F02F 1/16* (2013.01); *F02F 1/163* (2013.01); *F02F 11/005* (2013.01)

(58) Field of Classification Search

CPC .. F02F 1/004; F02F 1/14; F02F 11/005; F02F 1/16; F02F 1/163; F02F 1/166

See application file for complete search history.

(56) References Cited

U.S. PATENT DOCUMENTS

2008/0314353 A1* 12/2008 Highum ..... F02F 1/12 123/193.2
2016/0053707 A1* 2/2016 Batta ..... F02F 1/004 123/193.6

OTHER PUBLICATIONS

Kumar, K., "GASKET," U.S. Appl. No. 29/713,902, filed Nov. 19, 2019, 7 pages.
Kumar, K., "Sealing Apparatus With Retention Ribs," US. Appl. No. 29/713,904, filed Nov. 19, 2019, 10 pages.
Kumar, K. et al., "Engine Coolant System and Method," U.S. Appl. No. 16/688,939, filed Nov. 19, 2019, 46 pages.

* cited by examiner

*Primary Examiner* — Jacob M Amick
(74) *Attorney, Agent, or Firm* — McCoy Russell LLP

(57) ABSTRACT

Systems and methods are provided for a cylinder liner for an engine including a catcher feature on a side surface to provide radial support and improved coolant sealing. In one example, the catcher feature may include a continuous stepped catcher extending from the cylinder liner body and a stepped tab of the engine block, the stepped catcher resting on the stepped tab. Also, a radial flange in the upper portion of the cylinder liner may be coupled to the engine block, the coupling sealed via an O-ring nestled in a groove formed in the radial flange.

20 Claims, 4 Drawing Sheets

ENGINE CYLINDER LINER WITH LINER CATCHER

FIELD

Embodiments relate to engines. Other embodiments relate to cylinder liners for engine cylinders.

BACKGROUND

Internal combustion engines include a cylinder liner. Since engine block bores usually cannot withstand a prolonged sliding contact with the moving piston, the bores are reinforced by an insert in the form of a cylinder liner. The liner may include a flange that enables the liner to rest on an engine block. The cylinder liner is then held over the cylinder bore using vertical support via the flange.

However, the liner experiences wear over time due to exposure to heat and oil. The wear tends to be highest near the top dead center of the liner. This can result in the liner cracking at the flange. If the liner cracks at the flange, the vertical support required to hold the liner in place is lost. As a result, the bottom portion of the liner may slide down. In addition to hardware issues, the sliding down of the liner can cause oil to enter the combustion chamber, degrading engine performance.

The internal liner surface may have a special honing pattern to help minimize friction and wear, reduce possibility of piston seizure, and reduce oil consumption and gas leakage. Ring wear tends to be highest near the top dead center of the liner, when internal stresses are highest while the piston speed is close to zero, creating conditions for oil film collapse and liner flange degradation. Further, due to the upper portion of the liner being out of direct radial contact with the engine block, there may be undesirable relative movement between the liner and the cylinder head. This can result in degradation of a cylinder head gasket, or in the need for a thicker liner. Frequent cylinder head gasket replacement can be costly and can increase warranty issues. The need for a thicker cylinder liner can add to costs and decrease thermal conduction through the liner.

A higher pressure sealing between the cylinder liner and the engine block is essential for a diesel engine which relies on optimal pressure and temperature conditions for igniting fuel within the combustion chamber. If the cylinder liner and engine block are improperly sealed, then combustion gases may leak out of the cylinders during engine operation resulting in loss of power and engine efficiency. Also, improper sealing may result in oil, coolant, etc. to enter the combustion chamber, thereby adversely affecting engine performance.

BRIEF DESCRIPTION OF THE INVENTION

Methods and systems are provided for improving the component life and efficiency of a cylinder liner. In one embodiment, a cylinder liner comprises a liner catcher feature for holding the liner in place and reducing downward slippage of at least the bottom portion of the cylinder liner. For example, a cylinder liner may include: a hollow cylindrical body with an upper end and a lower end, the cylindrical body surrounding a combustion chamber defined by a cylinder bore formed in an engine block, a continuous radial flange extending from the cylindrical body at the upper end towards the engine block, the flange resting on a depression formed on the engine block; and a continuous stepped catcher extending from the cylindrical body at a location closer to the lower end than the upper end, the stepped catcher resting on a stepped tab of the engine block, the stepped tab extending from the engine block towards the liner. In this way, by using a stepped catcher feature, sliding of the liner may be averted.

In one example embodiment, a cylinder liner may include a radial flange towards the upper portion of the liner to support the liner in place around a cylinder bore. The radial flange may be in contact with a depression formed on the engine block (crankcase). An O-ring may be positioned in between the flange and the depression on the crankcase. Further down along the liner wall, a stepped feature may extend from the liner wall and engage with a stepped tab on a surface of the engine block. By including an O-ring in between the liner and the crankcase, and by using a liner catcher feature, slipping of the liner within the bore may be averted and an effective seal may be formed between the combustion chamber and the engine block.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTIONS OF FIGURES

The present invention will be better understood from reading the following description of non-limiting embodiments, with reference to the attached drawings, wherein below:

DETAILED DESCRIPTION

Figure 1:
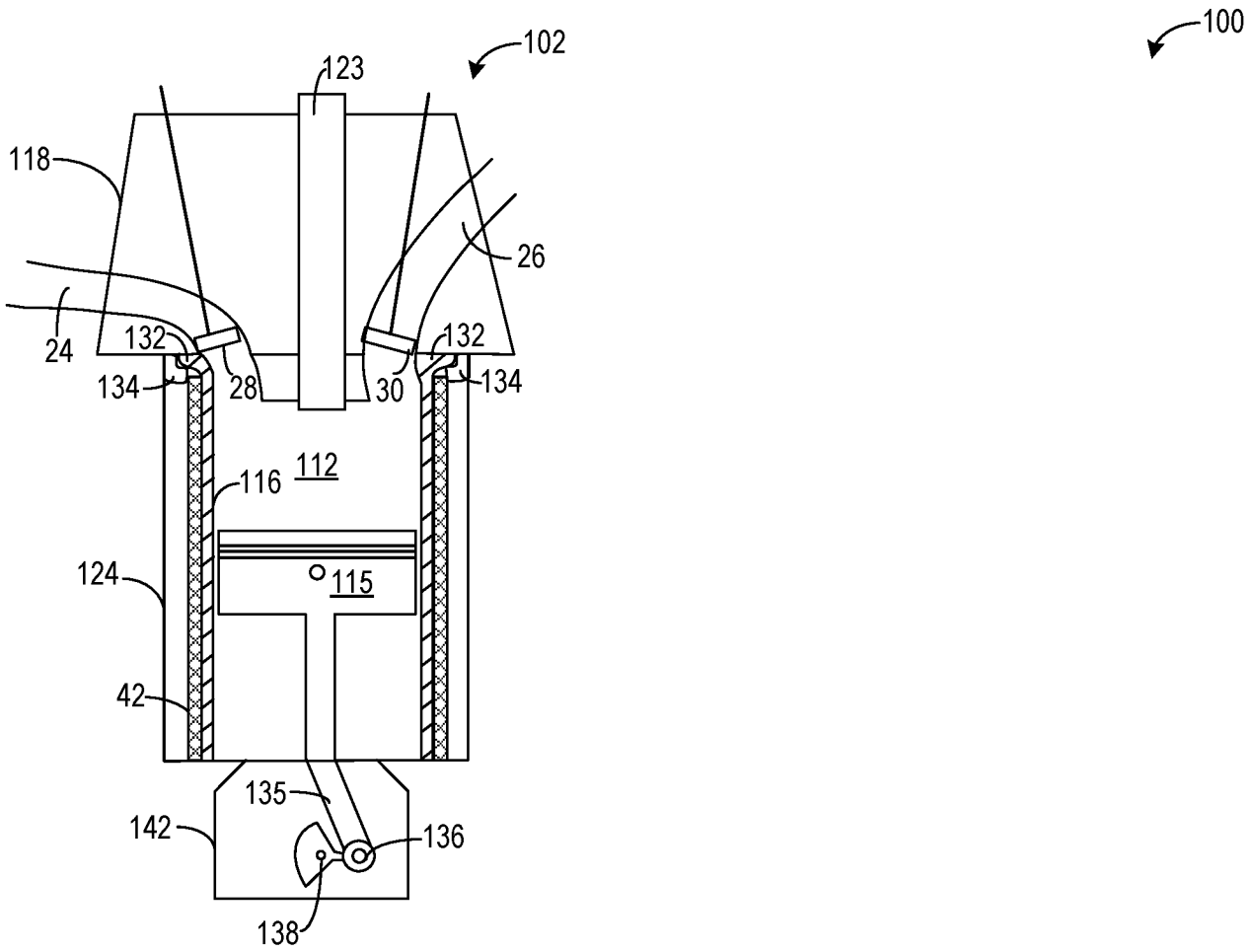
FIG. 1 shows a sectional view of an example cylinder in an engine.

FIG. 1 shows a cross sectional view 100 of an example cylinder 102 in a locomotive engine or other engine (of another type of vehicle or otherwise). The cylinder 102 may be part of an engine block including a plurality of cylinder bores 124 suitably formed therein (a single cylinder bore is shown in FIG. 1). A cylinder head 118 may be positioned atop the cylinder bore 124 and may abut upper surface of the walls around the cylinder bore 124. Gaskets (including a head gasket) and spacers may be used to position the cylinder head 118 above the cylinder bore 124. The cylinder bore 124 along with the corresponding cylinder head 118 may enclose a combustion chamber 112.

Combustion chamber 112 may be coupled to an intake port 24 and an exhaust port 26. During combustion, fuel and air mixture may be introduced from an intake manifold to the combustion chamber 112 via the intake port 24. An intake valve 28 may open during the intake stroke to admit a desired amount of the air fuel mixture. The cylinder head 118 may include a spark plug 123 to provide spark to the air fuel mixture in the combustion chamber 112 to initiate combustion. After combustion, residual gas mixture (exhaust) may be routed from the combustion chamber to an exhaust manifold via the exhaust port 26. During the exhaust stroke, an exhaust valve 30 may open facilitating removal of exhaust gas from the combustion chamber 112 to the exhaust manifold Each cylinder in the engine block may include a separate intake port 24 and an exhaust port 26 while sharing a common intake manifold and an exhaust manifold.

A cylinder liner 116 may be concentrically disposed in the cylinder bore 124 encasing the combustion chamber 112. By reinforcing the cylinder bore 124 with a cylinder liner, the inner wall of the cylinder bore 124 may be protected from wear caused by prolonged sliding contact with a moving piston. The liner typically includes a radial flange on an upper edge of the liner that enables the liner to rest on an engine block. The cylinder liner is then held over the cylinder bore using vertical support such as depressions 134 formed in the block via the flange 132. Details of the radial flange 132 and other features of the liner 116 will be discussed in relation to FIGS. 2-5. In one example, the cylinder liner 116 may have a constant diameter around the cylinder bore 124. In another example, diameter of the cylinder liner 116 may change between the cylinder head 118 and the crankcase cover 142.

A cylinder liner coolant jacket 42 may enclose the liner 116. The coolant jacket may be in direct contact with the cylinder liner, and during engine operation, coolant may be circulated through the coolant jacket to absorb heat from the combustion chamber 112 and the liner 116.

A piston 115 may be positioned within the combustion chamber 112 with a wrist pin coupling the piston 115 to a connecting rod 135 which has its lower end attached to the engine's crankshaft 138 via a crankpin 136. The crankshaft may be enclosed in a crankcase cover 142.

Figure 2:
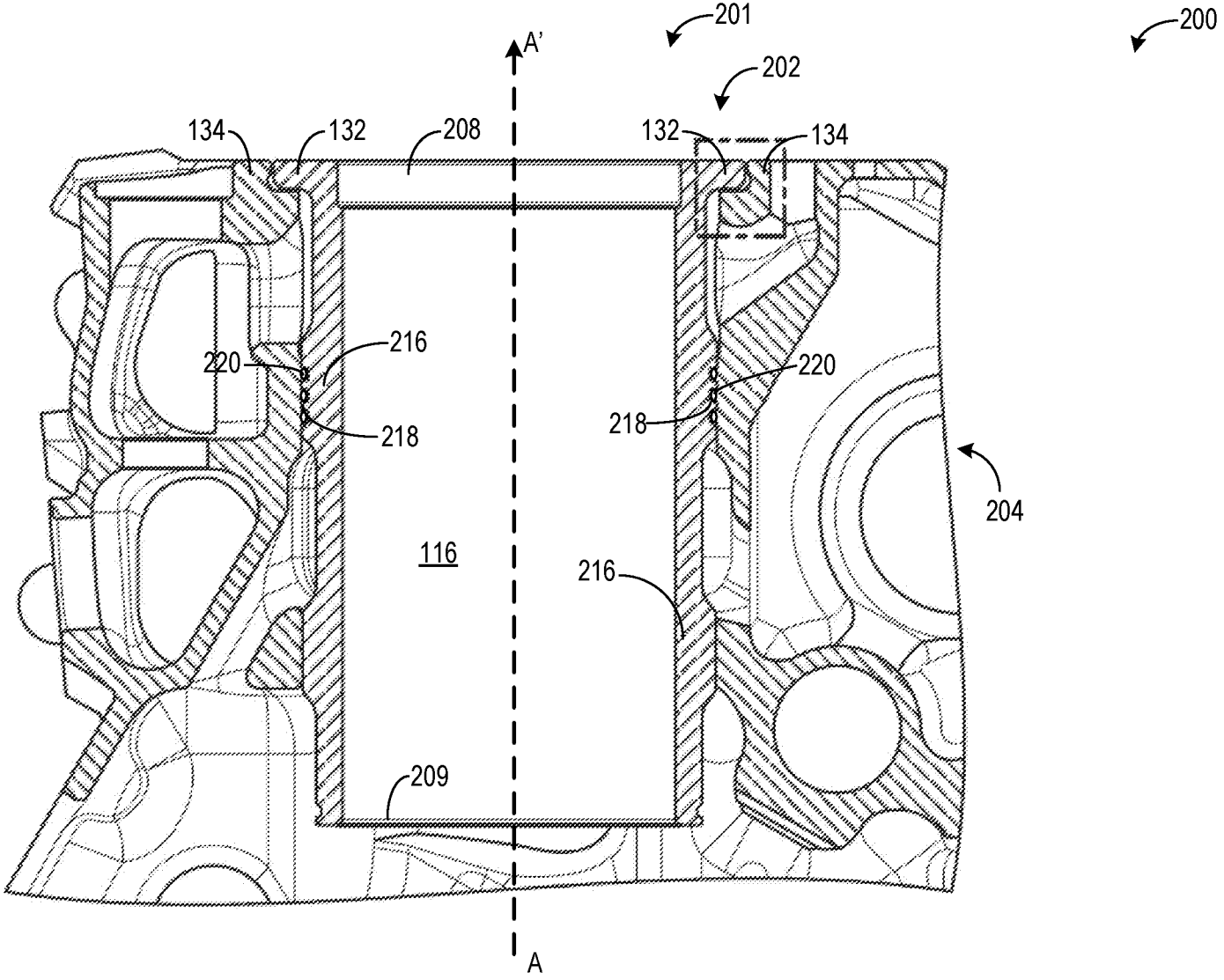
FIG. 2 shows a sectional view of a cylinder of an internal combustion engine with an associated cylinder liner, and an adjoining engine crankcase.

FIG. 2 shows a sectional view 200 of a cylinder 201 of an internal combustion engine with an associated cylinder liner 116 and an adjoining engine block 204 (also referred herein as engine crankcase). The liner 116 may be a hollow cylindrical structure including a wall 216, a top edge 208 proximal to the cylinder head, and a bottom surface 209 proximal to the crankshaft. The liner 116 may be radially symmetric around a central axis A-A'

The top edge 208 of the liner 116 may include a continuous radial flange 132 protruding outward from the central axis A-A'. The diameter of the radial flange 132 may be bigger than that of the cylinder bore. The engine block may include a depression 134 such as a groove on which the outer edge of the radial flange 132 may be supported. By supporting the top edge of the liner 116 on the complementary groove of the engine block, the liner 116 may be snugly engaged with the engine block. Details of the coupling of the flange 132 and depression 134 as shown by box 202 may be elaborated with relation to FIG. 3.

The liner 116 may be further supported via a series of elastomeric rings 220 coupled to the engine block 204. The elastomeric rings 220 may be received within corresponding annular recesses 218 formed in the liner wall 216. By engaging the elastomeric rings 220 with the recesses 218, the liner may be aligned within the cylinder bore. The recesses 218 in the liner 116 wall may be positioned below the radial flange 132 (along the wall 216). Further, a cylinder liner feature may be included to avert slippage of the liner within the bore. Details of the cylinder liner feature will be discussed in relation to FIGS. 4-5.

Figure 3:
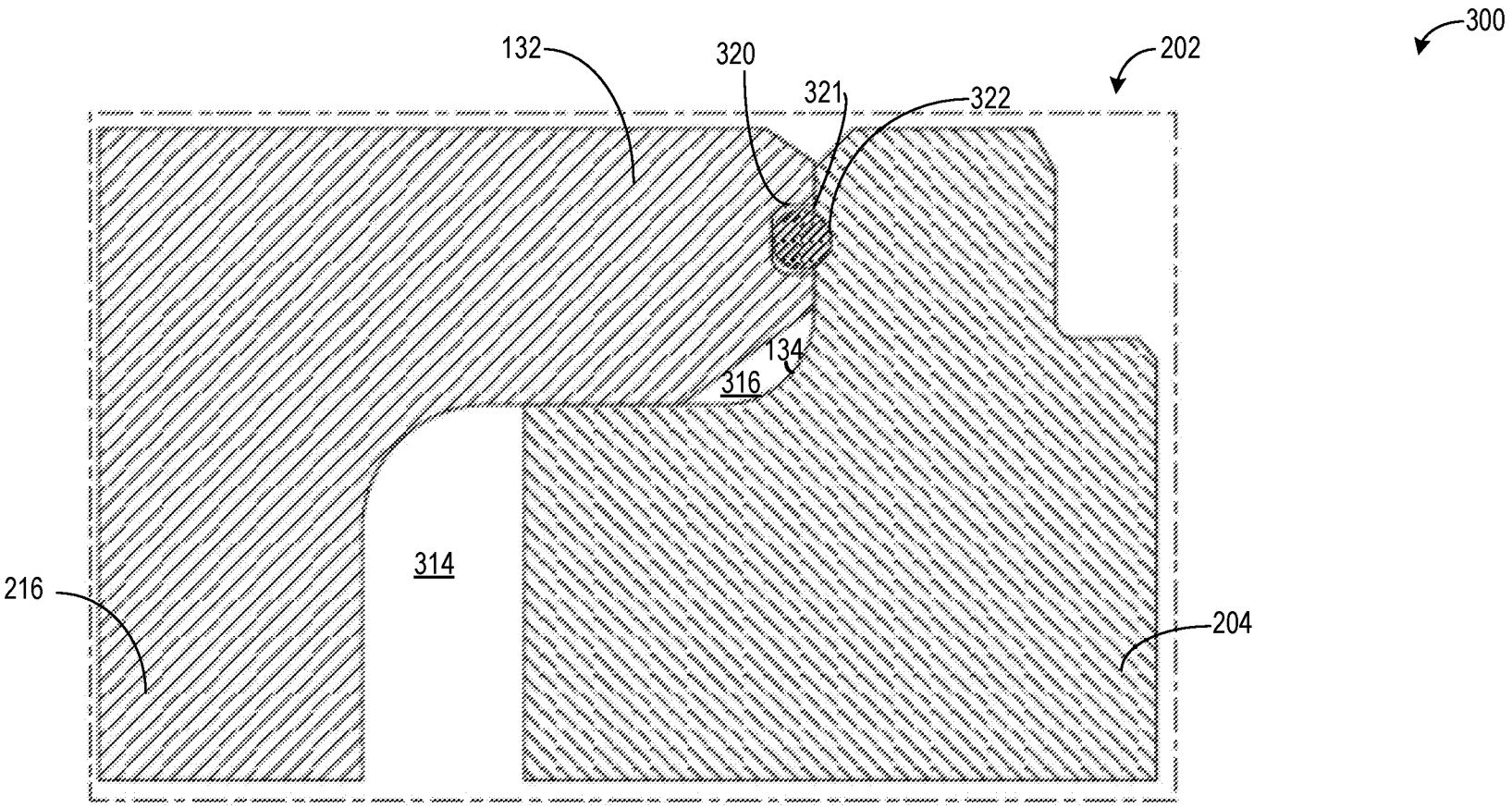
FIG. 3 shows a detailed view of an O-ring feature of the cylinder liner.

FIG. 3 shows a detailed view 300 of the coupling 202 of the flange 132 and engine block 204. As previously described, radial flange 132 may protrude outward from the circumference of the top edge of the cylinder liner wall 216. The radial flange 132 may include a curved (convex) outer edge with an angled lower surface. A circumferential groove 320 may be formed along the curved outer edge of the radial flange 132.

The engine block 204 may include a concave depression 134 on a surface adjoining the liner wall 216. The radial flange 132 may be positioned to rest (in physical contact) on the depression 134. A groove 321 may be formed on a wall of the depression, facing the circumferential groove 320 on the radial flange. An O-ring 322 may be nestled in the area enclosed by the circumferential groove 320 and the groove 321 when the radial flange 132 comes in contact with the depression 134 in the engine block 204.

O-ring 322 may be formed from a ductile material such as metal. In one example, O-ring 322 may comprise carbon steel, alloy steel, or a copper alloy. The O-ring may be manufactured by one of several methods, such as, forming a length of drawn wire into a circular shape, welding the ends of the wire together and smoothing the joint of the wire to eliminate a leak path. In addition, the O-ring 322 may be fully machined, or cold or hot formed from a solid blank. The alloy from which the O-ring is formed may be annealed and any known suitable heat treatment process may be utilized.

Upon engagement of the cylinder liner with the engine block 204, the O-ring may be compressed within the area formed by the corresponding grooves 320, 321 and a hollow region 316 may be formed between the depression 134 and the angled lower surface of the radial flange 132. During increased engine operating temperature, the hollow region 316 may provide space to accommodate dimensional changes (such as expansion) of the metal components. A hollow strip (cylindrical volume) 314 may be formed between the parallel walls of the cylinder liner and the engine block 204. In one example, a cylinder liner coolant jacket (such as coolant jacket 42 in FIG. 1) may be positioned within the hollow strip 314.

In this way, by using an O-ring to engage the cylinder liner with the engine block 204, the combustion chamber may be sealed and release of gases from the chamber may be averted. Also, due to the O-ring assisted sealing, engine oil and/or coolant may not enter the combustion chamber. Due to the presence of the O-ring, the undesirable relative movement between the liner and the cylinder head may be reduced, thereby decreasing degradation of the cylinder head gasket. By using an O-ring in the interface between the liner and the engine block, liner wear may be reduced, thereby reducing the desire for thicker and more expensive liners.

Figure 4:
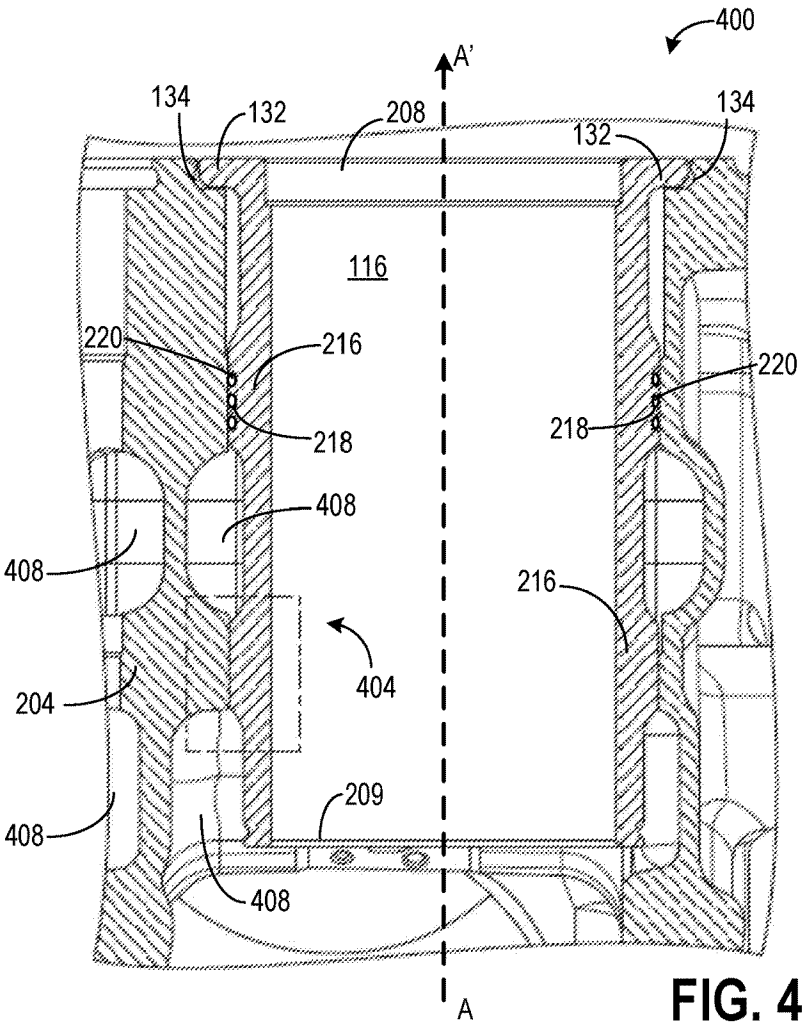
FIG. 4 shows a sectional view of catcher feature of the cylinder liner.

FIG. 4 shows a sectional view 400 of a stepped catcher 404 of the cylinder liner 116. The cylinder liner 116 may be engaged with the engine block 204 via a radial flange 132 resting on a depression 134 formed on the engine block and elastomeric rings 220 coupled to corresponding annular recesses 218 formed in the liner wall 216. Cavities 408 may be formed in the engine block wherein oil mist and crankcase gases may reside during engine operation.

However, due to wear, cracks may form on the radial flange 132 causing the top portion of the cylinder liner 116 to lose contact with the engine block. Due to such degradation in the radial flange 132, the cylinder liner may sag and slide downwards. In order to avert sliding of the cylinder liner, the stepped liner catcher feature 404 may be positioned along the liner wall 216 at a location closer to the lower end 209 than the upper end 208 of the cylinder liner 116. The stepped catcher 404 may be positioned axially downwards from the radial flange. Details of the stepped liner catcher feature 404 are described with relation to FIG. 5.

In this way, cylinder liner for a cylinder bore may include a liner body, a radial flange extending circumferentially from an upper end of the liner body and configured to engage an upper surface of the cylinder bore, and a stepped element extending circumferentially from the liner body and configured to engage a stepped tab on an engine block surface, the stepped element of the liner located axially below the flange.

Figure 5:
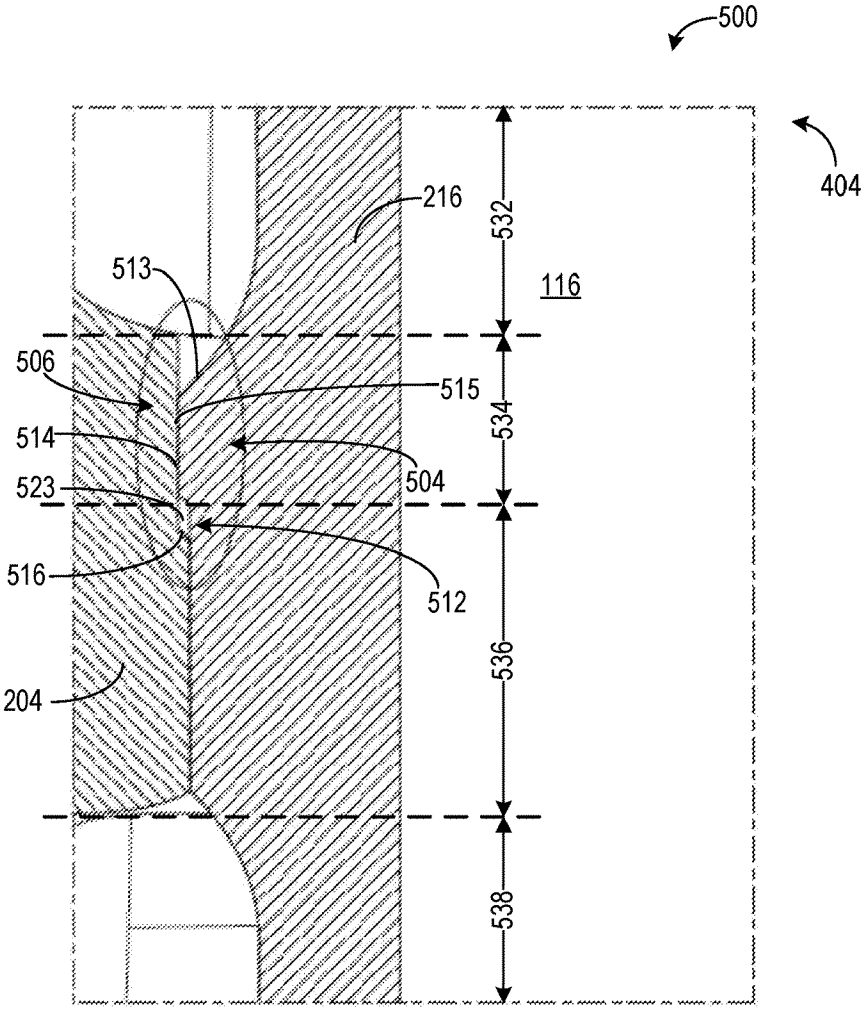
FIG. 5 shows a detailed view of the catcher feature of the cylinder liner.

FIG. 5 shows a detailed view 500 of the stepped liner catcher 404 of FIG. 4. The liner catcher 404 may be a continuous feature along the wall 216 of the cylinder liner 116 and the corresponding portion of the engine block 204. The stepped liner catcher 404 may be divided into four portions with a first portion 532 of the cylinder body above the liner catcher feature, a second portion 534 including an upper first step 504 of the catcher, a third portion 536 including a lower second step 512 of the catcher, and a fourth portion 538 of the cylinder body below the liner catcher feature.

The diameter of the cylinder liner may vary between two adjacent portions (along the side of the liner). As an example, the diameter of the liner may gradually increase from a first diameter in portion 532 to a second diameter in portion 534. However, the second diameter may be smaller than the diameter of the top circumference of the liner including the radial flange. The diameter of the liner may decrease from the second diameter in portion 534 to a third diameter, instantaneously, at a region axially below the step of the catcher (boundary of portion 534 and portion 536). The diameter of the liner may further decrease from the third diameter in portion 536 to the first diameter, abruptly (change in diameter is not gradual, thereby forming a shoulder), at a region axially below the stepped catcher (boundary of portion 536 and 538).

The first step 504 may have an upper edge 513 that is curved and a lower edge 515 that is rectilinear, the upper edge curving outwards from a surface of the liner towards the engine block surface. The curved upper edge 513 of the first step 510 may extend circumferentially from the liner forming a concave surface. The concave surface may engage with a rectilinear wall 514 of a stepped tab 506 on the engine block surface. The surface of the engine block engaging the radial flange at the top circumference of the liner may be curved while the other surface engaging the liner catcher at the catcher feature 404 may be rectilinear. Between the first step 510 and the second step 512, the lower edge 515 may be in direct contact with the rectilinear wall 514 of the stepped tab 506. A height of the stepped catcher (between an upper end of the liner and a lower end of the liner) may match a height of the stepped tab of the engine block. In this way, an upper surface of the first step 510 curves towards the lower end of the liner while extending away from a central axis (not shown) of the cylinder bore, and a lower surface of the second step 512 is rectilinear.

The stepped tab 506 may include the rectilinear wall 514 and an angled surface 516 at the end of the rectilinear wall 514. The angled surface 516 may be positioned axially below the lower second step 512 with a gap 523 in between. If due to degradation of the radial flange, the cylinder liner slips along the wall of the cylinder bore, the second step 512 may align with the angled surface 516, thereby blocking further slippage of the liner. The gap 523 provides a tolerance region for dimensional changes such as expansion of the metallic components.

In this way, the components of FIGS. 1-5 enable a system, including: an engine block including a cylinder bore and an engine block, a coolant passage positioned between the cylinder bore and the engine block, the coolant passage circulating coolant around the cylinder bore, and a cylindrical liner extending around an inner surface of the bore, the liner including a flange extending radially along a circumference of an upper end of the cylinder bore, the flange engaging a surface of the engine block, the liner further including a stepped catcher surrounding the outer surface of the bore axially below the flange, the stepped catcher including an upper step extending further outwards than a lower step, the upper step engaging another surface of the engine block.

In an embodiment, a cylinder liner includes: a hollow cylindrical body with an upper end and a lower end, the cylindrical body configured to surround a combustion chamber defined by a cylinder bore formed in an engine block, a continuous radial flange extending from the cylindrical body at the upper end (e.g., towards the engine block, when the liner is disposed in the bore), the flange configured to rest on a depression formed on an engine block, and a continuous stepped catcher extending from the cylindrical body at a location closer to the lower end than the upper end, the stepped catcher configured to rest on a stepped tab of the engine block, the stepped tab extending from the engine block. The stepped catcher may be positioned axially downwards from the radial flange. In any or all of the preceding examples, additionally or optionally, a diameter of the liner gradually increases from a first diameter of the cylindrical body to a second diameter on an upper end of the catcher. In any or all of the preceding examples, additionally or optionally, the second diameter on the upper end of the catcher is smaller than a diameter of the flange. In any or all of the preceding examples, additionally or optionally, the diameter of the liner decreases from the second diameter to a third diameter instantaneously at a lower end of the stepped catcher. In any or all of the preceding examples, additionally or optionally, the diameter of the liner decreases from the third diameter to the first diameter, at a region axially below the stepped catcher (e.g., forming a right-angled shoulder). In any or all of the preceding examples, additionally or optionally, a height of the stepped catcher between the upper end and the lower end matches a height of the stepped tab of the engine block. In any or all of the preceding examples, additionally or optionally, at the upper end, the stepped catcher has an outer concave surface. In any or all of the preceding examples, additionally or optionally, an outer edge of the radial flange includes a circumferential groove, the liner further comprising an O-ring nestled in the groove, the flange resting on the engine block via the O-ring.

Another example cylinder liner (configured to be disposed in a cylinder bore) includes: a liner body; a radial flange extending circumferentially from an upper end of the liner body and configured to engage an upper surface of the cylinder bore; and a stepped element extending circumferentially from the liner body and configured to engage a stepped tab on an engine block surface, the stepped element of the liner located axially below the flange. In any of the preceding examples, additionally or optionally, the stepped element is positioned proximate to a lower end of the liner. In any or all of the preceding examples, additionally or optionally, the stepped element includes a first, upper step and a second, lower step, a diameter of the liner being larger at the upper step than the lower step. In any or all of the preceding examples, additionally or optionally, the first step has an upper edge that is curved and a lower edge that is rectilinear, the upper edge curving outwards from a surface of the liner towards the engine block surface. In any or all of the preceding examples, additionally or optionally, the curved upper edge forms a concave surface, and wherein the lower edge is engaged with the stepped tab of the engine block surface. In any or all of the preceding examples, additionally or optionally, the radial flange includes an outer circumferential groove housing an O-ring.

In yet another example, a system includes: an engine block including a cylinder bore, a coolant passage positioned in the engine block and configured to circulate coolant around the cylinder bore, and a cylindrical liner disposed in the bore, the liner including a flange extending radially along a circumference of an upper end of the cylinder bore, the flange engaging a surface of the engine block, the liner further including a stepped catcher extending around an inner surface of the bore axially below the flange, the stepped catcher including an upper step extending further outwards than a lower step, the upper step engaging another surface of the engine block. In any preceding example, additionally or optionally, an upper surface of the upper step curves towards the lower end of the liner while extending away from a central axis of the bore, and wherein a lower surface of the lower step is rectilinear. In any or all of the preceding examples, additionally or optionally, a diameter of the liner at the flange is larger than the diameter of the liner at the first step, wherein the surface of the engine block engaging the flange is curve while the another surface engaging the liner catcher is rectilinear. In any or all of the preceding examples, additionally or optionally, a diameter of the liner at the flange is larger than the diameter of the liner at the first step. In any or all of the preceding examples, additionally or optionally, the liner includes a groove along an outer edge of the flange, the groove housing an O-ring, the flange engaging the surface of the engine block via the O-ring.

In this way, by including a stepped liner catcher in the liner and a corresponding portion of the engine block wall (e.g., tab), slippage of the liner may be averted. During a possible slippage of the liner, the tab on the engine block wall may catch the stepped feature on the liner wall, thereby stopping further slippage. The technical effect of using an O-ring in the interface of the top portion of the cylinder liner and the engine block is that a higher pressure sealing is provided between the cylinder liner and the engine block for optimal pressure and temperature conditions desired to ignite fuel within the combustion chamber. Further, optimal sealing of the cylinder liner and engine block may reduce the possibility of gases to leak from the combustion chamber, thereby improving engine performance.

This written description uses examples to disclose the invention, and to enable one of ordinary skill in the relevant art to practice embodiments of the invention, including making and using the devices or systems and performing the methods. The patentable scope of the invention is defined by the claims, and may include other examples that occur to one of ordinary skill in the relevant art. Such other examples are intended to be within the scope of the claims if they have structural elements that do not differ from the literal language of the claims, or if they include equivalent structural elements with insubstantial differences from the language of the claims.

The invention claimed is:

1. A system, comprising:

an engine block, comprising:

a stepped tab having a first wall with a first diameter, a second wall with a second diameter which is less than the first diameter, the second wall extending inward towards a cylinder liner, and an angled shoulder between the first wall and the second wall; and a cylinder liner, comprising:

a hollow cylindrical body with an upper end and a lower end, the cylindrical body configured to surround a combustion chamber defined by a cylinder bore in the engine block;

a continuous radial flange extending from the cylindrical body at the upper end, the flange configured to rest on a depression formed on the engine block; and a continuous stepped catcher of the cylindrical body at a location closer to the lower end than the upper end, the stepped catcher comprising a first portion with a diameter matching the first diameter of the first wall and a second portion with a diameter matching the second diameter of second first wall, and an angled step connecting the first portion and the second portion of the stepped catch, the angled step configured to rest on the stepped tab.

2. The system of claim 1, wherein the stepped catcher is positioned axially downwards from the radial flange.

3. The system of claim 1, wherein the second diameter on the upper end of the catcher is smaller than a diameter of the flange.

4. The system of claim 1, wherein the diameter of the cylinder liner decreases from the first diameter of the cylinder bore to the second diameter of the cylinder bore instantaneously at the angled step.

5. The system of claim 1, wherein a height of the stepped catcher between the first portion and the second portion matches a height of the angled shoulder of the block.

6. The system of claim 1, wherein the stepped catcher has an outer concave surface.

7. The system of claim 1, wherein an outer edge of the radial flange includes a circumferential groove, the liner further comprising an O-ring nestled in the groove, the flange configured to engage the block via the O-ring.

8. A system, comprising:

an engine block, comprising:

a stepped tab having a first wall with a first diameter, a second wall with a second diameter which is less than the first diameter, the second wall extending inward towards a cylinder liner, and an angled shoulder between the first wall and the second wall; and a cylinder liner, comprising:

a liner body;

a radial flange extending circumferentially from an upper end of the liner body and configured to engage an upper surface of the cylinder bore; and a stepped element extending circumferentially from the liner body, the stepped element comprising a first portion with a diameter matching the first diameter of the first wall and a second portion with a diameter matching the second diameter of second first wall, and an angled step connecting the first portion and the second portion of the stepped element, the angled step configured to engage the angled shoulder of the engine block, and the stepped element of the liner located axially below the flange.

9. The system of claim 8, wherein the stepped element is positioned proximate to a lower end of the liner body.

10. The system of claim 8, wherein when the liner is disposed in the bore the first portion curves outwards from a surface of the liner towards the engine block surface.

11. The system of claim 10, wherein the curved upper edge forms a concave surface.

12. The system of claim 8, wherein the radial flange includes an outer circumferential groove housing an O-ring.

13. A system, comprising:

an engine block including a cylinder bore, the engine block comprising:

a stepped tab having a first wall with a first diameter, a second wall with a second diameter which is less than the first diameter, the second wall extending inward towards a cylinder liner, and an angled shoulder between the first wall and the second wall;

a coolant passage in the engine block configured to circulate coolant around the cylinder bore; and a cylinder liner disposed in the bore, the cylinder liner comprising:

a flange extending radially along a circumference of an upper end of the cylinder bore, the flange engaging a surface of the engine block; and a stepped catcher extending around an inner surface of the bore axially below the flange, the stepped catcher including an upper step with a diameter matching the first diameter of the first wall and a lower step with a diameter matching the second diameter of second first wall, the upper step extending further outwards than the lower step, and an angled step connecting the upper step and the lower step, the upper step engaging the first wall of the engine block and the angled step engaging the angled shoulder of the engine block when the cylinder liner moves downward into the cylinder bore.

14. The system of claim 13, wherein an upper surface of the upper step curves towards the lower end of the liner while extending away from a central axis of the bore, and wherein a lower surface of the lower step is rectilinear.

15. The system of claim 13, wherein a diameter of the liner at the flange is larger than the diameter of the liner at the first step, wherein the surface of the engine block engaging the flange is curved while the another surface engaging the liner catcher is rectilinear.

16. The system of claim 13, wherein a diameter of the liner at the flange is larger than the diameter of the liner at the first step.

17. The system of claim 13, wherein the liner includes a groove along an outer edge of the flange, the groove housing an O-ring, the flange engaging the surface of the engine block via the O-ring.

18. The system of claim 1, further comprising rings coupled to the engine block; and recesses in the cylinder liner configured to mate with the rings.

19. The system of claim 8, further comprising rings coupled to the engine block; and recesses in the cylinder liner configured to mate with the rings, and the recesses positioned between the radial flange and the stepped element.

20. The system of claim 13, further comprising elastomeric rings coupled to the engine block; and recesses in the cylinder liner configured to mate with the rings, and the recesses positioned between the radial flange and the stepped element.

* * * * *